United States Patent [19]

Woods, Jr.

[11] Patent Number: 4,726,096

[45] Date of Patent: Feb. 23, 1988

[54] ELECTRIC MOISTURE CONTROL DEVICE FOR COTTON GIN

[75] Inventor: Cleatus Woods, Jr., Humboldt, Tenn.

[73] Assignee: Farmers Gin and Grain of Humboldt, Inc., Humboldt, Tenn.

[21] Appl. No.: 909,213

[22] Filed: Sep. 19, 1986

[51] Int. Cl.[4] ..... D01B 3/04

[52] U.S. Cl. ..... 19/66 CC; 19/0.21

[58] Field of Search ..... 19/0.21, 66 CC

[56] References Cited

U.S. PATENT DOCUMENTS

| | | | |
|---|---|---|---|
| 2,442,478 | 6/1948 | Watson | 19/0.21 |
| 2,636,223 | 4/1953 | De Santis et al. | 19/0.21 |
| 2,759,225 | 8/1956 | Hunter et al. | 19/0.21 X |
| 2,834,058 | 5/1958 | Bryant | 19/66 CC |
| 2,914,809 | 12/1959 | Buzick | 19/66 CC |
| 3,005,238 | 10/1961 | Manning | 19/66 R |
| 3,114,175 | 12/1963 | Bryant | 19/66 CC |
| 3,114,938 | 12/1963 | Bryant | 19/66 CC |
| 3,324,513 | 6/1967 | Hurdt | 19/66 CC |
| 3,363,286 | 1/1968 | Scott et al. | 19/66 CC |
| 3,392,424 | 7/1968 | Mangialardi et al. | 19/66 CC |
| 3,451,105 | 6/1969 | Nayfa | 19/66 CC |
| 3,881,222 | 5/1975 | Roberson | 19/66 R |
| 4,021,887 | 5/1977 | Jackson | 19/66 R |
| 4,103,397 | 8/1978 | Jackson | 19/66 CC |
| 4,140,503 | 2/1979 | Vandergriff | 55/290 |
| 4,253,215 | 3/1981 | Mangialardi | 19/66 CC |
| 4,450,677 | 5/1984 | Von Ronai-Horvath et al. | 57/81 |

FOREIGN PATENT DOCUMENTS

| | | | |
|---|---|---|---|
| 0328222 | 10/1967 | U.S.S.R. | 19/66 CC |

*Primary Examiner*—Louis K. Rimrodt

*Attorney, Agent, or Firm*—Fleit, Jacobson, Cohn & Price

[57] ABSTRACT

A moisture spray device is positioned in overlying relation to the link slide and the cotton batt which moves down the slide with photoelectric sensing devices being provided on the lint slide for controlling a valve that supplies water to the spray device thus controlling the discharge of moisture onto the cotton batt in response to the thickness of the cotton batt. Time delay switches are incorporated to prevent the moisture control valve from shutting down in the event of a momentary break in the cotton batt and to allow the lint cotton in the slide to start normal flow after the tramper starts.

7 Claims, 3 Drawing Figures

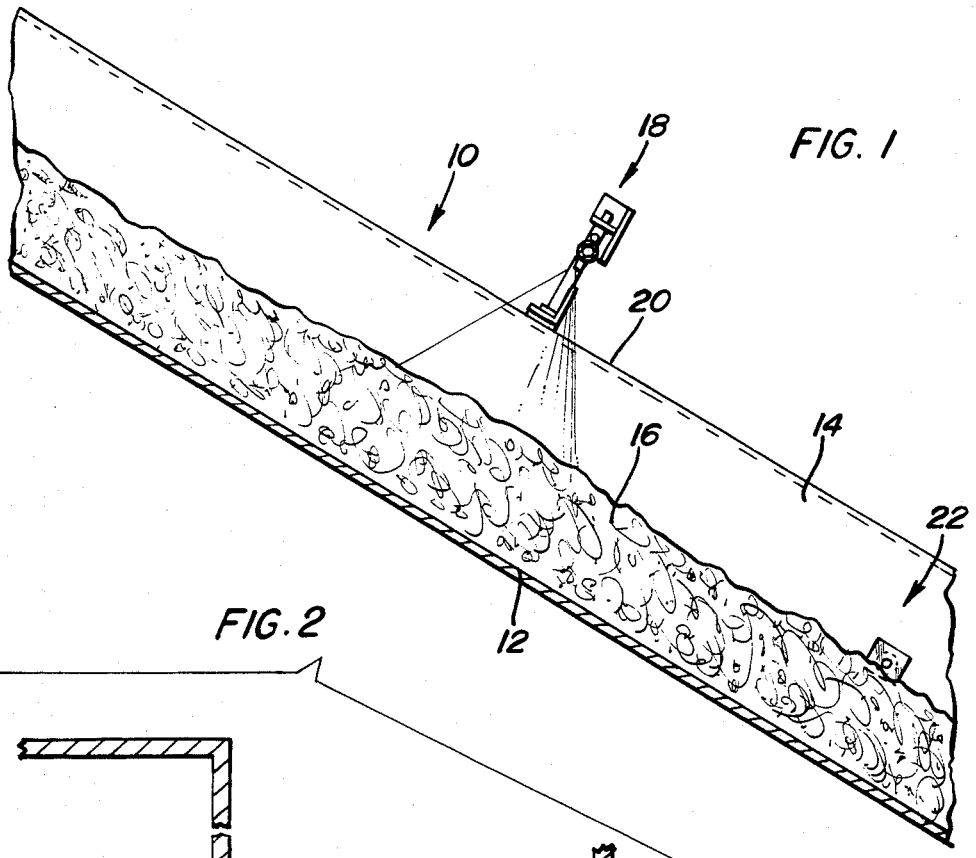
FIG. 1
FIG. 2
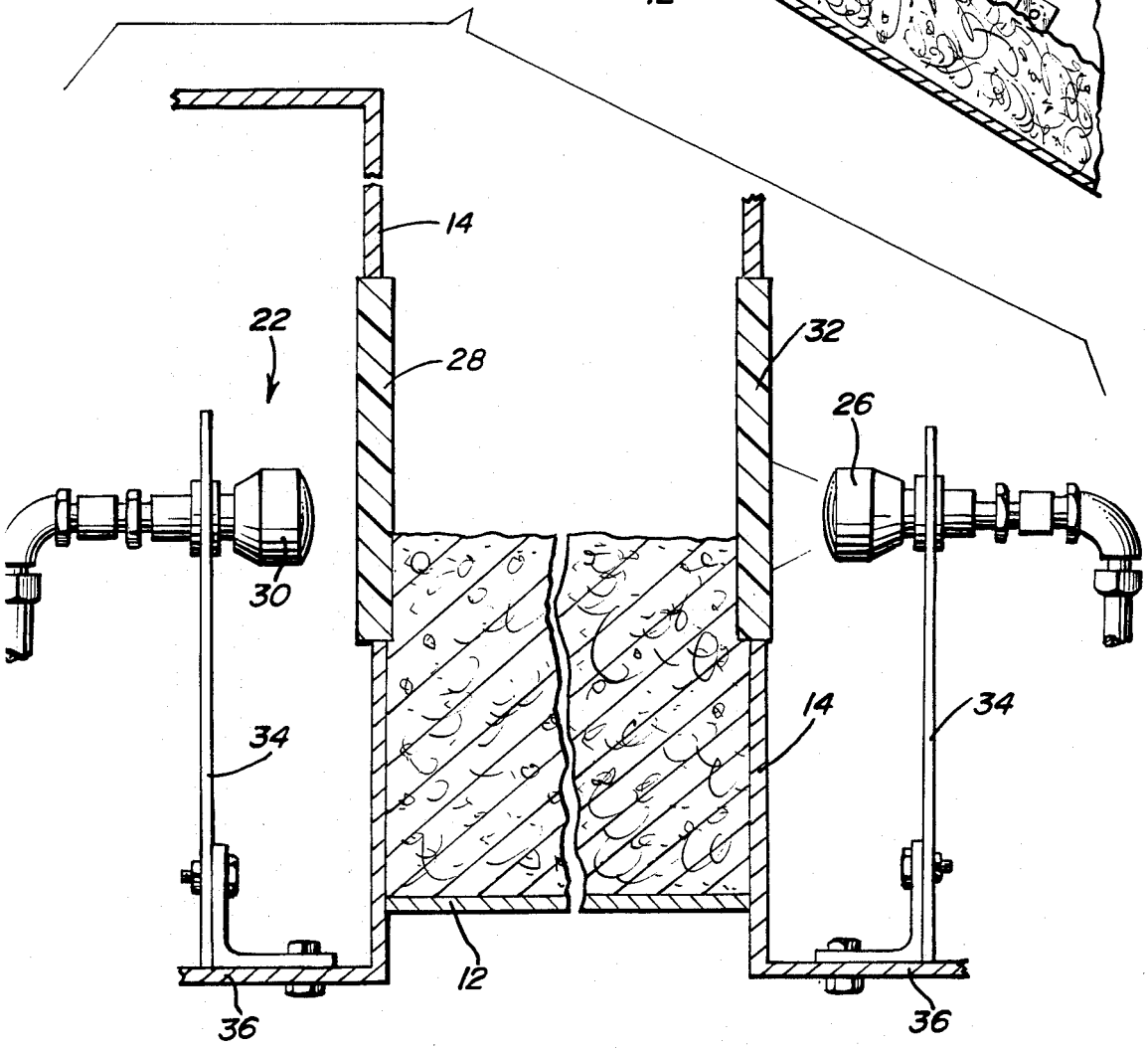

ELECTRIC MOISTURE CONTROL DEVICE FOR COTTON GIN

BACKGROUND OF THE INVENTION

1. Field of the Invention

The present invention generally relates to the art of ginning cotton and more particularly to the restoration of moisture to cotton during the ginning process as the lint cotton proceeds down the lint slide from the battery condenser to the tramper or bale press. A moisture spray device is positioned in overlying relation to the lint slide and the cotton batt which moves down the slide with photoelectric sensing devices being provided on the lint slide for controlling a valve that supplies water to the spray device thus controlling the discharge of moisture onto the cotton batt in response to the thickness of the cotton batt. Time delay switches are incorporated to prevent the moisture control valve from shutting down in the event of a momentary break in the cotton batt and to allow the lint cotton in the slide to start normal flow after the tramper starts.

2. Information Disclosure Statement

When ginning cotton, substantial moisture is removed which results in the tramper operating under higher pressure requirements and also introduces the possibility of discharge of static electricity which has built up in the dry cotton. It is desirable and devices are known to introduce moisture in the form of a water spray, mist or humid air onto or into the lint cotton as it slides down the lint slide. Details of the developments in this art and their relationship to the present invention are incorporated in a separate disclosure statement. The known prior art in this field of endeavor does not include photocells or photoelectric sensing devices for controlling discharge of moisture onto the cotton batt in response to the thickness of the cotton batt nor does the prior art disclose the use of time delay assemblies to prevent the moisture control device from shutting down in the event of a momentary break in the cotton batt and at the initiation of the tramper to enable the lint cotton to commence a normal flow down the lint slide.

SUMMARY OF THE INVENTION

An object of the present invention is to provide a moisture control for restoring moisture to lint cotton that was removed during the ginning process in order to reduce static electricity and reduce the time and pressures required in forming a cotton bale, usually about three to five pounds of water per bale, while at the same time providing an increase in weight of cotton bales without damaging the cotton in which the addition of moisture is controlled in response to the thickness of the cotton batt moving down the lint slide from the battery condenser to the tramper.

Another object of the invention is to provide a moisture control device in accordance with the preceding object in which a photoelectric sensing assembly is associated with the lint slide to sense the thickness of the cotton batt and control the discharge of moisture in response to the sensed thickness combined with a time delay switch which will prevent the moisture discharge valve from being closed in the event of a momentary break in the cotton batt.

A further object of the invention is to provide a moisture control device in accordance with the preceding objects in which another time delay switch is provided to enable normal flow of cotton to occur between the battery condenser and tramper upon initial start up of lint cotton flow from the battery condenser to the tramper with the components being adjusted to provide effective control of the moisture discharge valve in order to discharge a quantity of moisture onto the cotton batt commensurate with the quantity of moisture required for a cotton batt of a thickness equal to the distance between the bottom of the lint slide and the position of the photosensitive assembly.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic view of the lint slide incorporating the moisture control device of the present invention therein.

FIG. 2 is a schematic transverse sectional view, on an enlarged scale, illustrating the structure of one of the photosensitive assemblies associated with the lint slide.

DESCRIPTION OF THE PREFERRED EMBODIMENT

Figure 3:
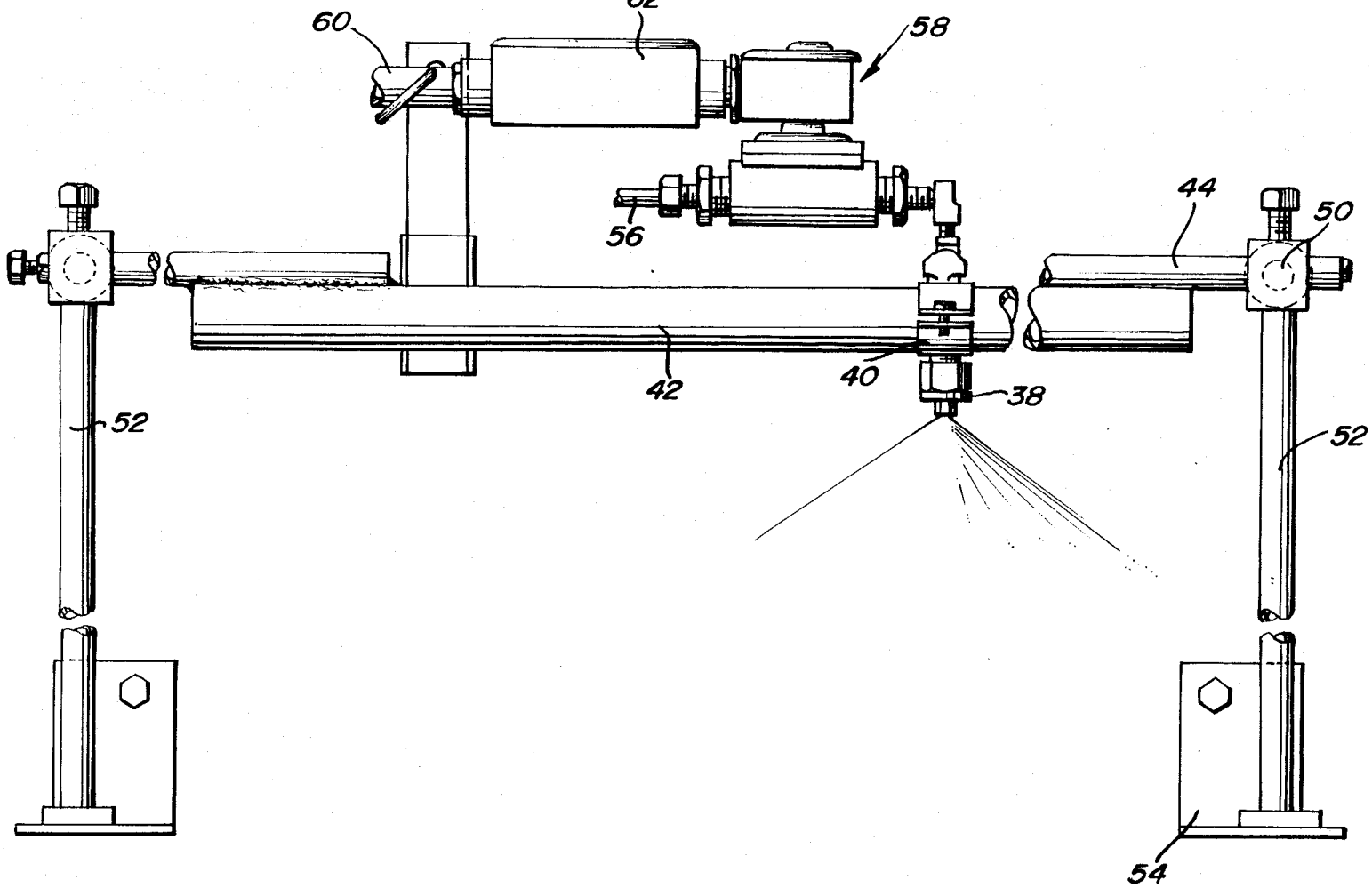
FIG. 3 is a schematic transverse view illustrating the structure of the moisture discharge nozzle and control valve assembly.

Referring now specifically to the drawings, the moisture control device of the present invention is incorporated into a lint slide generally designated by numeral 10 which extends downwardly in an inclined relationship from the battery condenser which forms a portion of a conventional cotton ginning process to the tramper of the bale press in which the existing components of the cotton ginning process are not shown. A portion of the lint slide 10 is shown in the drawings and includes a bottom panel 12 and side panels 14 perpendicular thereto with the lint slide receiving, containing and guiding a batt 16 of lint cotton from the cotton gin to the bale press. A moisture discharging assembly 18 is associated with the lint slide 10 to discharge water downwardly in a spray pattern 20 onto the upper surface of the cotton batt 16. The moisture control device of the present invention includes a photoelectric sensing assembly 22 which is located in spaced relation to the moisture discharge assembly 18 longitudinally of the lint slide 10 with the sensing assembly 22 being disposed downwardly of the moisture applying assembly 18.

As illustrated in FIG. 2, the photoelectric sensing assembly 22 includes a light emitting device or source 26 oriented in alignment with a transparent insert 28 incorporated into the sidewall 14 of the lint slide. Located outwardly of the other sidewall 14 and in alignment with the light 26 is a light detector or receiving member 30 oriented in alignment with a transparent insert 32 in the other sidewall 14. The light or emitter 26 and the detector or receiver 30 are connected electrically to a control circuit and are supported by bracket structures 34 attached to flanges 36 at the bottom of the lint slide 10 to enable initial adjustment of the position of the photoelectric sensing assembly in relation to the transparent inserts 28 and 32.

The moisture discharging assembly 18 includes a discharge nozzle 38 supported by a suitable clamp bracket 40 on a horizontal tube or rod 42 which includes extensions 44 supported on brackets 50 at the upper end of supporting rods or tubes 52 which extend downwardly and are connected to brackets 54 connected to the lint slide 10 so that the nozzle 38 may be adjusted in relation to the lint slide and the cotton batt 16 passing therethrough. Water is supplied under a predetermined pressure through a hose or pipe 56 connected to an electrically controlled water valve 58 which is connected to an electrical source through a cable 60 and connector or junction box 62.

While installational arrangements may vary depending upon the existing structure of the lint slide, the mounting brackets or plates 54 are preferably mounted on the upper flanges of the lint slide approximately 2 feet from the top of the slope or top of the lint slide with a center line of the spray assembly used as the measuring point. The components of the spray assembly are assembled with the spray tip 38 in a centered position over the lint slide. A supporting bracket or strap is provided for the line connector assembly 62 with this structure being arranged so that the horizontal measurement from the battery condenser will be approximately 20 to 22 inches. The conduit, pipe, copper tube or the like 56 is connected with a valve and pressure gauge assembly (not shown) which are mounted in a convenient location to supply water at a predetermined pressure to the electric water valve assembly 58 and spray tip assembly 38. A source of water is connected to the regulating valve and pressure gauge in a well known manner with this assembly being arranged to discharge an equal volume spray of water completely across the upper surface of the cotton batt as it slides down the lint slide. The photosensitive assembly including the source light 26 and the detector and receiver 30 are mounted from the lower flanges of the lint slide approximately 5 feet from the top of the slope of the lint slide and the transparent windows are installed in the wall of the lint slide and the windows should be approximately 6 inches by 12 inches and mounted so that the photocell source and detector can be adjusted vertically 4 to 7 inches from the lower flange of the lint slide. A control panel is conveniently supported in an area near the photosensitive assembly to provide electrical power to the photosensitive assembly and may be conveniently supported on the lower flange of the lint slide and includes electrical connection with the spray discharge valve as well as the photosensitive assembly. The electrical panel includes two time delay arrangements electrically associated with the electrical system through a suitable terminal board as well as an on/off switch with the electrical components including a conventional timing relay such as a pneumatic timing relay set at 5 seconds or some other desired time factor which will allow cotton travel to smooth out after the cotton press is turned between each bale of cotton before the moisture spray is actuated. A second time delay is located inside of a demodulator mounted on the terminal board with this delay being used to prevent the system from being turned off prematurely from a momentary break in the lint cotton batt. This time delay may be preset for a one second delay which would eliminate the spray from being shut down in the event of a momentary break in the cotton batt. These components are standard components oriented and electrically connected in accordance with accepted procedures. Of course, moisture content of the cotton in the lint slide should be periodically checked and the system adjusted to take into account variations in the moisture content of the lint cotton discharged down the lint slide which can vary depending upon the moisture content of the cotton being processed as well as humidity conditions in the surrounding environment. Generally, it is preferable that water be added in an amount of about three to five pounds per bale of cotton.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A moiture control device for lint cotton for restoring moisture lost during the cotton ginning process, said device comprising:

moisture discharge means positioned in overlying relation to a lint slide and to discharge moisture onto the upper surface of a cotton batt moving along the lint slide, sensing means operatively associated with said moisture discharge means and the cotton batt passing along the lint slide to sense the thickness of the cotton batt and control said moisture discharge means in response to the sensed thickness, said moisture discharging means including a water spray nozzle connected to a pressure regulated source of water and an electrically controlled valve operatively associated with said sensing means to control water released by said electrically controlled value in response to the sensed thickness of the cotton batt, first time delay means associated with said sensing means and said moisture discharge means to prevent cessation of the discharge of water during a predetermined amount of break in the cotton batt moving along the lint slide, and second time delay means enabling initial start up of the lint cotton flow along the lint slide when the cotton bale press has been turned, thereby enabling the cotton batt to reach a predetermined flow, as evidenced by the sensed thickness, without starting operation of said moisture discharge means.

2. The device as defined in claim 1 wherein said sensing means includes a photoelectric sensing assembly.

3. The structure as defined in claim 2 wherein said photoelectric assembly includes a source light at one side of the cotton batt and a light detector at the other side of the cotton batt so that the upper surface of the cotton batt will occlude light passage from the source to the detector when the thickness of the cotton batt reaches a predetermined thickness.

4. The device as defined in claim 3 wherein the lint slide includes transparent windows in the opposite walls thereof in alignment with the light source and detector and means mounting the light source and detector for adjustment to enable the occlusion of the light passing between the source and detector to occur at different elevations.

5. The device as defined in claim 1 wherein the quantity of water discharged onto the cotton batt by the moisture discharge means is between about three to five pounds per bale with the water being evenly distributed throughout the bale.

6. The method of restoring moisture to lint cotton during the cotton ginning process including the steps of:

positioning a water discharge means above a cotton batt passing down an inclined lint slide between a battery condenser and a tramper, controlling operation of said water discharge means in response to the vertical thickness of a cotton batt passing down the slide, preventing deactivation of said water discharge means during a predetermined amount of break in the cotton batt passing down the slide over a predetermined amount of time, and delaying activation of said water discharge means until a predetermined vertical thickness of the cotton batt passing down the slide is detected.

7. The method as defined in claim 6 including the step of positioning a photoelectric sensing means transversely of the path of movement of the cotton batt to sense the vertical thickness thereof.

* * * * *